US005957565A

United States Patent [19]

Hofmann

[11] Patent Number: 5,957,565

[45] Date of Patent: Sep. 28, 1999

[54] RECESSED REFLECTOR-TYPE LIGHT

[75] Inventor: Harald Hofmann, Lüdenscheid, Germany

[73] Assignee: Erco Leuchten GmbH, Lundenscheid, Germany

[21] Appl. No.: 08/795,004

[22] Filed: Feb. 5, 1997

[30] Foreign Application Priority Data

Feb. 5, 1996 [DE] Germany ..... 196 03 846
Aug. 14, 1996 [DE] Germany ..... 196 32 665

[51] Int. Cl.[6] ..... F21S 1/02

[52] U.S. Cl. ..... 362/147; 362/364; 362/355; 362/307

[58] Field of Search ..... 362/307, 343, 362/355, 147, 364, 365

[56] References Cited

U.S. PATENT DOCUMENTS 2,879,377 3/1959 Layng ..... 362/343
5,020,252 6/1991 De Boef ..... 362/223

FOREIGN PATENT DOCUMENTS 225476 7/1908 Germany .
616 604 7/1935 Germany .
1 262 182 9/1968 Germany .
23 36 418 2/1975 Germany .
43 11 013 10/1993 Germany .

*Primary Examiner*—Thomas M. Sember
*Attorney, Agent, or Firm*—Herbert Dubno; Andrew Wilford

[57] ABSTRACT

A reflector light has a reflector having a reflective inner surface having an edge defining a ceiling plane and substantially symmetrical to a symmetry plane perpendicular to the ceiling plane and a rear-end compartment bisected by the symmetry plane and remote from the ceiling plane. A lamp or primary light source is provided in the compartment on the symmetry plane. An at least partially light-passing diffuser separate from the reflector and spaced toward the surface from the lamp is substantially symmetrical to the symmetry plane and has a light-emitting flat outer surface directed toward the ceiling plane. The surfaces are shaped such that light emitted by the diffuser surface is reflected by the reflector surface outward in a space symmetrical to the symmetry plane and defined by a family of lines tangenting the reflector edge and traversing the symmetry plane. The diffuser surface lies between the family of lines and the lamp.

15 Claims, 4 Drawing Sheets

RECESSED REFLECTOR-TYPE LIGHT

FIELD OF THE INVENTION

The present invention relates to a recessed light. More particularly this invention concerns a reflector-type down-light having a reflector with a reflector surface formed as a body of revolution or generally cylindrical.

BACKGROUND OF THE INVENTION

A recessed reflector-type downlight described in German patent document 1,262,182 of E. Price and I. Goodbar of the socalled dark light type is designed based on the concept that the light source is an array of point sources. The curvature of the reflector is set such that the light is cast in a strictly defined space shaped, when the reflector is symmetrical to a vertical line, as a cone and, when the reflector is elongated with two sides symmetrical to a vertical plane, as a downwardly flaring triangular-section band. With appropriate shaping of one side of the reflector, the system can be used for casting most of its light laterally for wall-washing effect.

In such a system the shape of the reflector, determined by a complex calculation, is such that light emitted by the surface of the light source is reflected by the reflector surface formed on the inside of the reflector outward in a space symmetrical to a symmetry plane of the reflector and defined by a family of lines tangenting an edge of the reflector and traversing the symmetry plane at a common point or line. The result is areas to either side of the fixture that get no light directly off the light source or reflector surface. For this to happen the light source has to be confined to a predetermined space within the rear end of the reflector, that is with its light-emitting surface in a predetermined position relative to the reflector surface, as otherwise the beam cast by the reflector will not have the desired shape. Ideally the light-emitting surface must lie on the above-mentioned family of lines that cross at the symmetry plane and tangent the reflector edge, but above the point or line where they cross. If the light source projects downward past this imaginary region, the light will not illuminate as desired and as required by a high-quality down-light.

When such a fixture is used with a high- or low-voltage halogen lamp or with a particularly small-format incandescent or fluorescent bulb, in particular in a wall-washing application as described in German patent document 2,336,418 of E. Price, it is impossible to achieve the desired effect. Such lamps often have irregular surfaces that cannot be used with an accurately shaped reflector.

OBJECTS OF THE INVENTION

It is therefore an object of the present invention to provide an improved reflector light.

Another object is the provision of such an improved reflector light which overcomes the above-given disadvantages, that is which can be counted on to cast an accurate beam of light even if used with differently shaped primary light sources or bulbs.

SUMMARY OF THE INVENTION

A reflector light has according to the invention a reflector having a reflective inner surface having an edge defining a ceiling plane and substantially symmetrical to a symmetry plane perpendicular to the ceiling plane and a rear-end compartment bisected by the symmetry plane and remote from the ceiling plane. A lamp or primary light source is provided in the compartment on the symmetry plane. An at least partially light-passing diffuser separate from the reflector and spaced toward the surface from the lamp is substantially symmetrical to the symmetry plane and has a light-emitting flat outer surface directed toward the ceiling plane. The surfaces are shaped such that light emitted by the diffuser surface is reflected by the reflector surface outward in a space symmetrical to the symmetry plane and defined by a family of lines tangenting the reflector edge and traversing the symmetry plane. The diffuser surface lies between the family of lines and the lamp.

Thus with such an arrangement the placement of the light-emitting surface of the lamp or bulb is less critical since, in effect, the lamp's light is re-emitted by the surface of the diffuser acting as a secondary light source. So long as the lamp is above the diffuser, the beam cast by the light according to this invention will be perfectly defined. It is even possible to employ a high-voltage halogen lamp of the type having a highly contoured outer surface and still have the light cast its light beam exactly as intended.

According to the invention the flat diffuser does not work in the normal manner, that is like a lens oriented somewhere near the bulb. Instead according to the invention the effective light-emitting surface of the diffuser is positioned so that it is at or behind the family of lines defining the desired beam limits. The lamp is positioned somewhat back so that if it is a little out of position or of somewhat different shape than what was originally planned, the light will still emit the intended beam.

According to the invention the diffuser is formed with an array of throughgoing holes. It is opaque so that light can only pass through it at the holes and can be formed as a mesh. Alternately the diffuser is translucent, so-called milk glass, or is formed of a plurality of elements defining a multiplicity of light-passing holes. The holes are particularly useful in that they pass air that can cool the lamp.

When the lamp is compact, that is generally spherical or a short cylinder, the reflector surface is symmetrical to a line in the symmetry plane and the edge is circular. Thus the reflector surface can be conical or frustoconical. The line passes through the center of the lamp and the reflector surface flares from the lamp to the edge.

When the lamp is an elongated tube, as in a fluorescent fixture, the reflector surface has a pair of sides symmetrically flanking the symmetry plane and formed as warped planes.

Either way the diffuser is formed with at least one throughgoing hole dimensioned large enough to insert a finger through so that it can be used for removing and installing the diffuser when the bulb is being changed. For an elongated bulb the reflector surface is symmetrical to a line in the symmetry plane and the edge is circular and the hole is centered on the line. Thus the reflector surface has a pair of sides symmetrically flanking the symmetry plane and formed as warped planes and the hole is centered on the symmetry plane. According to the invention the ratio of diameter (for a round hole in a rotation-symmetrical reflector) or width (for a slot in an elongated reflector) to reflector diameter or width at the edge is between 1:6 and 1:7.

The diffuser according to the invention has an outer edge forming a gap with the reflector surface so that air can circulate through the gap and hole. Furthermore the diffuser is provided with mounting formations engaging the reflector and extending across the gap at spaced locations.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
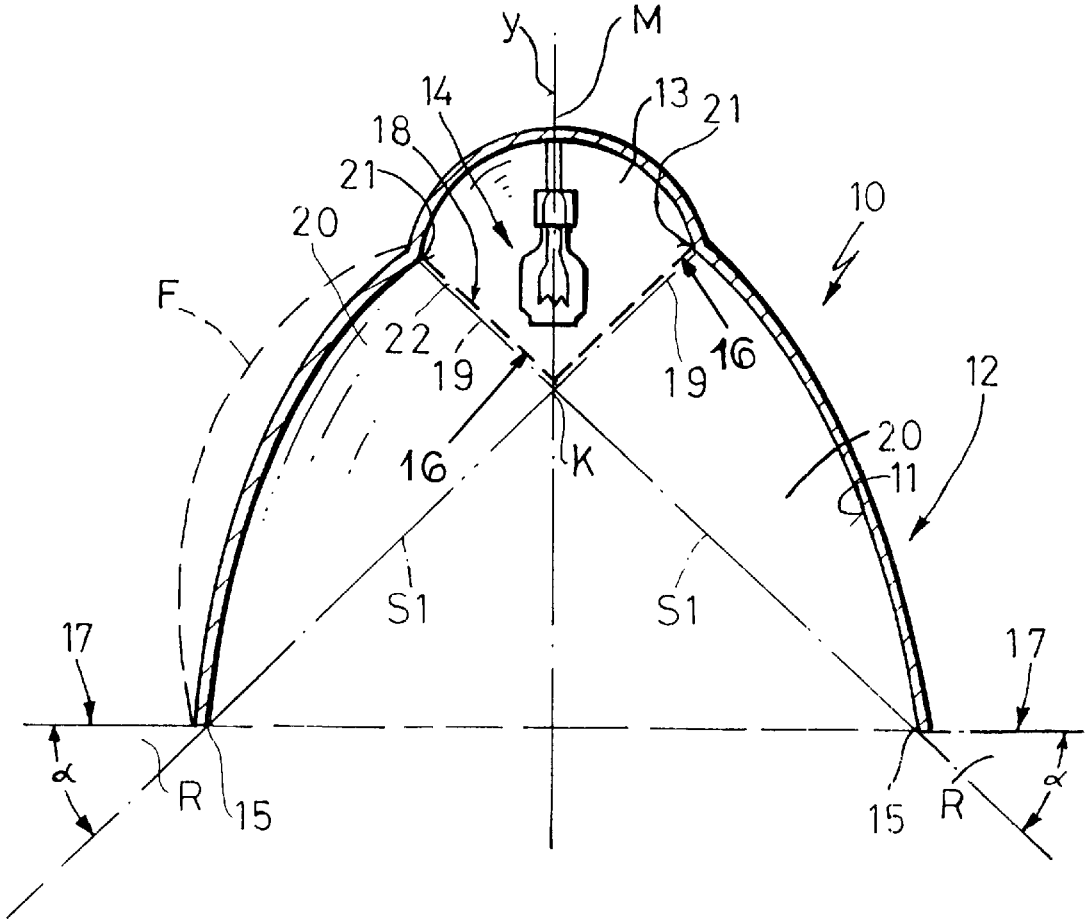
FIG. 1 is a vertical section through a reflector-type recessed light according to the invention.

As seen in FIG. 1 a reflector light 10 according to the invention has a one-piece reflector housing 12 with a reflective or mirrored inner surface 11 formed as a surface of revolution centered on an upright axis y. The surface 11 ends at its front edge 15 at a ceiling plane 17. The reflector has an interior 20 in a rear region 13 of which is a lamp 14, here a halogen bulb. The reflector surface 11 is shaped such that light from the bulb 14 is projected downward within a cone having an apex K on the axis y and sides formed by a family of lines S1 extending downward from this point K tangent to the circular edge 15. This therefore forms dark regions R of angular dimension a around the light 10 that get no direct light from the bulb 14.

According to the invention a mesh or perforated diffuser 16 is provided in the housing 12. This diffuser 16 is conical with a point at the point K and an outer surface 22 extending in line with the lines Sl defining the light cone generated by the light 10. The diffuser 16 is formed with an array of throughgoing holes 19 and is clipped or snap-fitted at formations 21 to the reflector 12.

Although here the reflector surface 11 is a surface of revolution centered on the axis y, it could also be formed as a pair of warped planes extending parallel to a plane M including the axis Y and perpendicular to the plane of the view of FIG. 1. In this case the lamp 14 would be replaced with, for instance, a series of such lamps 14 or an elongated light tube extending along the plane M. In addition one side of the reflector 12 could be bowed out as shown at F for a wall-washing effect.

Figure 2:
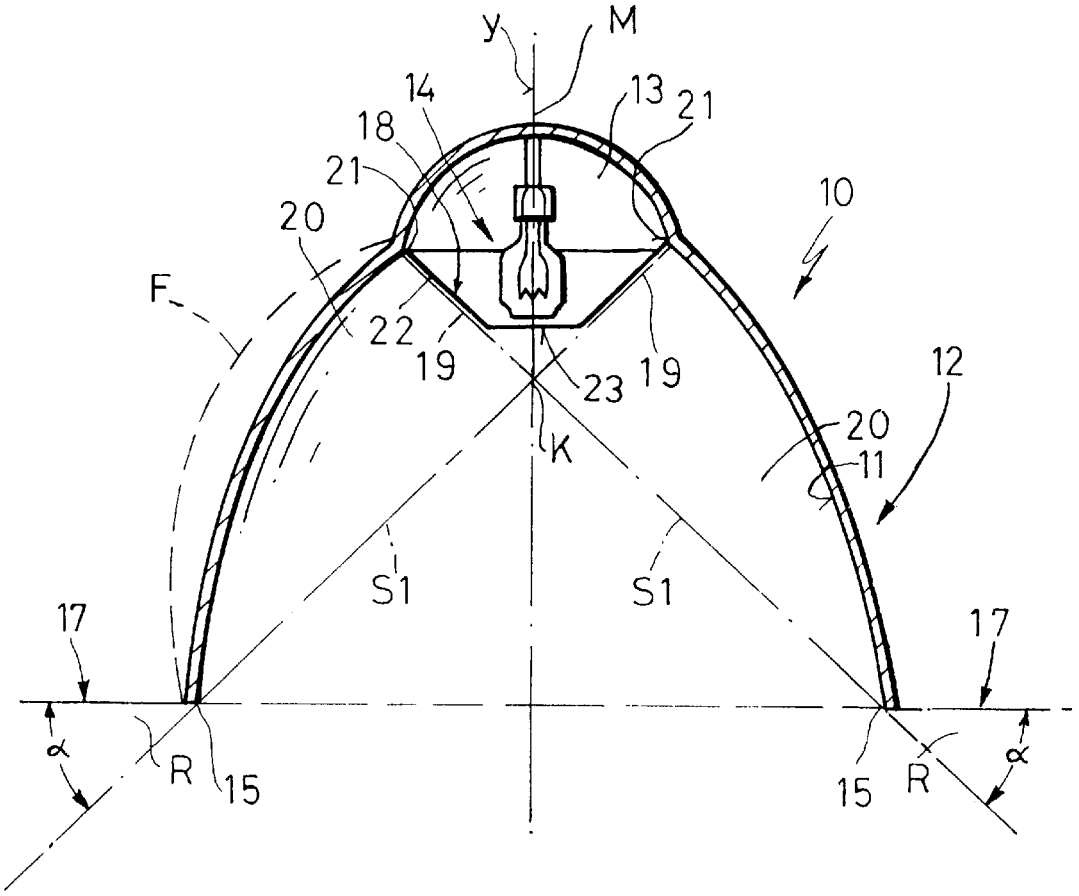
FIG. 2 is a view like FIG. 1 of another light according to the invention.
Figure 3:
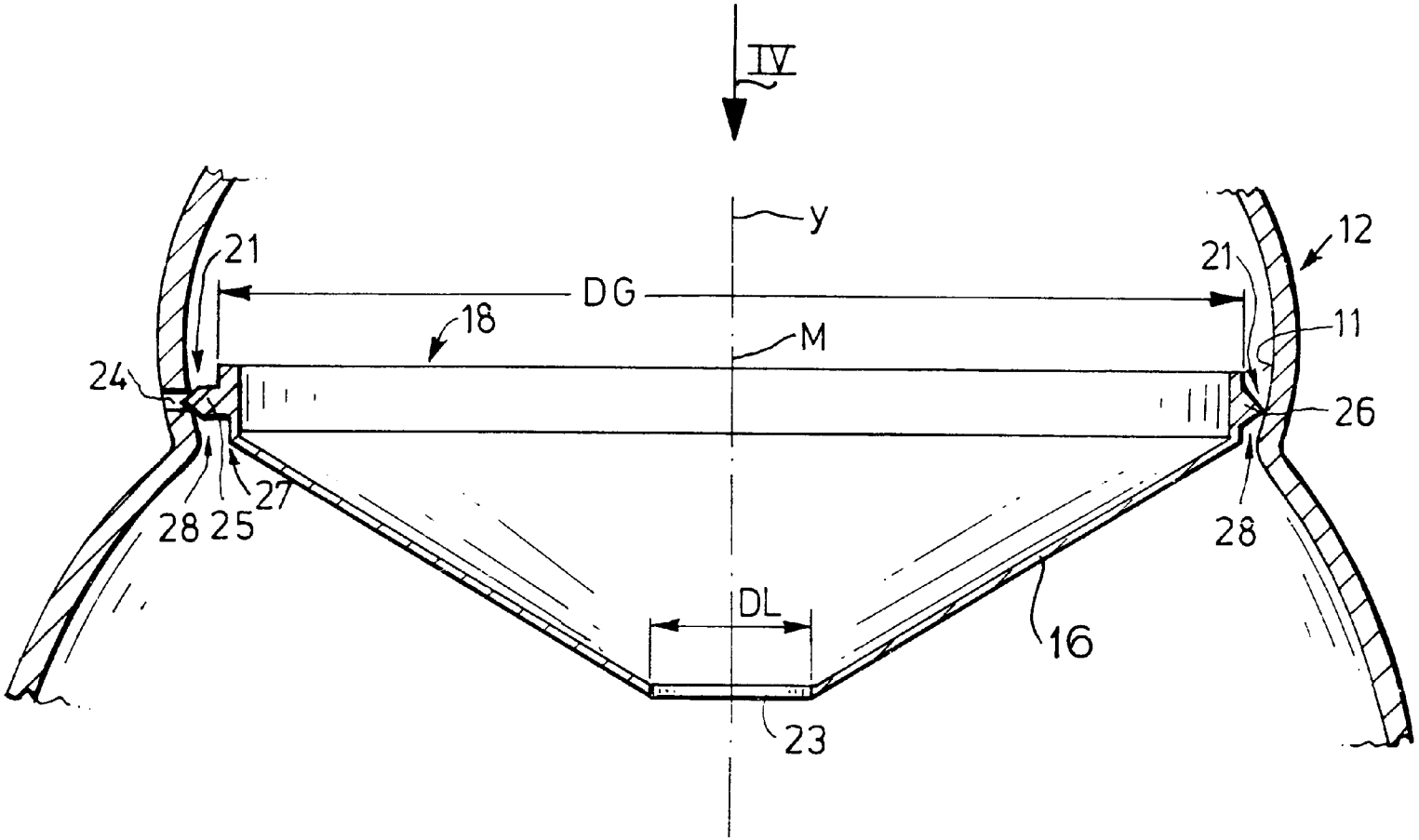
FIG. 3 is a larger-scale view of a detail of FIG. 2.
Figure 4:
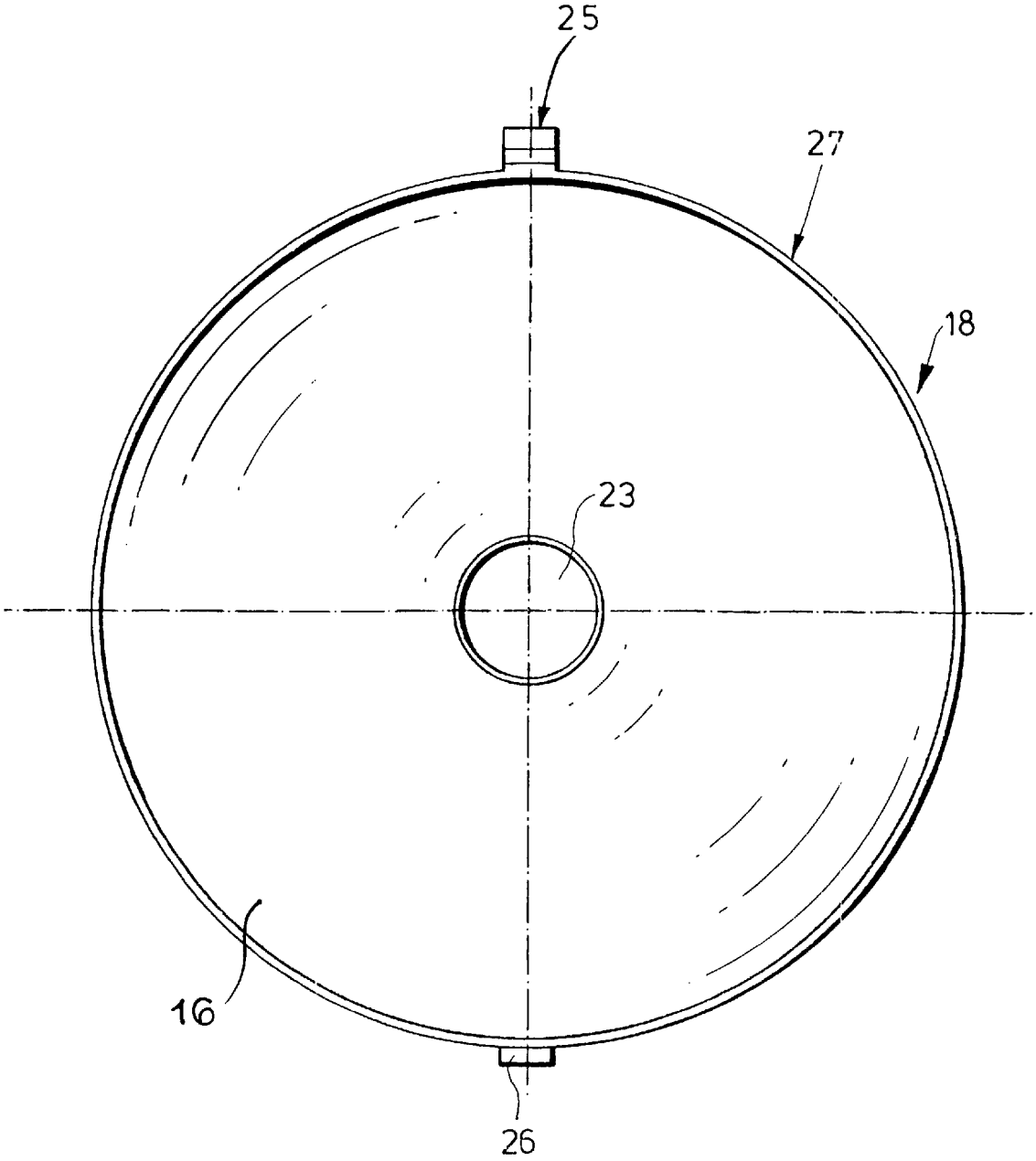
FIG. 4 is a view taken in the direction of arrow IV of the diffuser of FIG. 3.

In FIGS. 2, 3, and 4, where reference numerals identical to those of FIG. 1 are used for functionally identical structure, the diffuser 18 is frustoconical and translucent but is formed on the axis Y with a central hole 23. This hole 23 has a diameter DL (FIG. 3) of about 20 mm. The overall diameter DG of the diffuser is 130 mm. According to the invention the ratio DL:DG is thus equal to 1:6.5.

In addition as shown in FIGS. 3 and 4 the diffuser 18 has an outer edge or rim 27 formed with diametrically opposite retaining formations 21. The formation 21 on one side is a pin 25 that fits into a hole 24 in the reflector 12. The diametrically opposite formation 21 is a small bump 26 that frictionally engages the inner wall of the reflector housing 12. This forms a gap 28 between the rim and the inner surface of the reflector housing 12 and the diffuser 18. Once again, if the system is extended and made symmetrical to the plane M, two such pins 25 are needed to keep the diffuser 18 level and solidly positioned.

The diffuser 18 made of polycarbonate and the hole 23 is big enough to insert a finger through so it can be used for installing and removing the diffuser. The center hole 23 and gap 28 allow considerable air circulation through the rear lamp compartment 13.

I claim:

1. A reflector light comprising:

a reflector having a reflective inner surface having a front edge defining a ceiling plane and substantially symmetrical to a symmetry plane perpendicular to the ceiling plane and a rear edge and a forwardly open rear-end compartment bisected by the symmetry plane, extending rearward from the rear edge, and remote from the ceiling plane;

a lamp in the compartment on the symmetry plane, and an at least partially light-passing diffuser separate from the reflector, lying between the reflector front edge and the lamp, substantially symmetrical to the symmetry plane, and having a light-emitting outer surface directed toward the ceiling plane, the reflector surface being shaped such that light emitted by the diffuser surface is reflected by the reflector surface outward in a space symmetrical to the symmetry plane and bounded by a family of lines extending from the rear reflector edge, tangenting the reflector front edge and traversing the symmetry plane, the diffuser surface lying between the family of lines and the lamp.

2. The reflector light defined in claim 1 wherein the diffuser is formed with an array of throughgoing holes.

3. The reflector light defined in claim 2 wherein the diffuser is opaque, whereby light can only pass through it at the holes.

4. The reflector light defined in claim 2 wherein the diffuser is formed as a mesh.

5. The reflector light defined in claim 1 wherein the diffuser is translucent.

6. The reflector light defined in claim 1 wherein the diffuser is formed of a plurality of elements defining a multiplicity of light-passing holes.

7. The reflector light defined in claim 1 wherein the reflector surface is symmetrical to a line in the symmetry plane and the front edge is circular.

8. The reflector light defined in claim 7 wherein the reflector surface flares from the lamp to the front edge.

9. The reflector light defined in claim 1 wherein the reflector surface has a pair of sides symmetrically flanking the symmetry plane and formed as warped planes.

10. The reflector light defined in claim 1 wherein the diffuser is formed with at least one throughgoing hole.

11. The reflector light defined in claim 10 wherein the reflector surface is symmetrical to a line in the symmetry plane and the front edge is circular and the hole is centered on the line.

12. The reflector light defined in claim 10 wherein the reflector surface has a pair of sides symmetrically flanking the symmetry plane and formed as warped planes and the hole is centered on the symmetry plane.

13. The reflector light defined in claim 10 wherein the hole is large enough for a finger to fit through it.

14. The reflector light defined in claim 10 wherein the diffuser has an outer edge forming a gap with the reflector surface, whereby air can circulate through the gap and hole.

15. The reflector light defined in claim 14 wherein the diffuser is provided with mounting formations engaging the reflector and extending across the gap at spaced locations.

* * * * *